US008128456B2

(12) United States Patent
Liu

(10) Patent No.: US 8,128,456 B2
(45) Date of Patent: Mar. 6, 2012

(54) MOLDED BREAST CUP AND A BRASSIERE INCORPORATING SUCH A BREAST CUP

(75) Inventor: Zhen Qiang Liu, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 388 days.

(21) Appl. No.: 12/463,651

(22) Filed: May 11, 2009

(65) Prior Publication Data

US 2010/0285722 A1 Nov. 11, 2010

(51) Int. Cl.
*A41C 3/00* (2006.01)

(52) U.S. Cl. ..... 450/39; 450/54; 450/57

(58) Field of Classification Search ..... 450/36–39, 450/54–58; 2/267, 268
See application file for complete search history.

(56) References Cited

U.S. PATENT DOCUMENTS

| | | | | |
|---|---|---|---|---|
| 3,826,266 | A * | 7/1974 | Alpert | 450/11 |
| 6,165,047 | A * | 12/2000 | Scott et al. | 450/55 |
| 6,390,885 | B1 * | 5/2002 | Brooks | 450/1 |
| 7,118,444 | B2 * | 10/2006 | Newman | 450/58 |
| 7,413,495 | B1 * | 8/2008 | Sobah-Wilhelm | 450/58 |
| 2006/0079153 | A1 * | 4/2006 | Davidson | 450/58 |

* cited by examiner

*Primary Examiner* — Gloria Hale
(74) *Attorney, Agent, or Firm* — Ostrolenk Faber LLP

(57) ABSTRACT

The invention includes a molded breast cup comprising an outer panel which includes an outer fabric layer and an inner panel including an inner fabric layer to be worn against a wearer's skin. A middle layer is disposed between the outer panel and the inner panel. The middle layer comprises fill being sufficiently thick such that the outer panel corresponds to a breast cup size which is more than one breast cup size and preferably two breast cup sizes above the breast cup size which corresponds to the inner panel.

17 Claims, 3 Drawing Sheets

MOLDED BREAST CUP AND A BRASSIERE INCORPORATING SUCH A BREAST CUP

FIELD OF THE INVENTION

The present invention relates to molded brassieres and particularly to breast cups having a seamless construction. Moreover, the invention relates to brassieres and breast cups intended to enhance a wearer's bust by creating the illusion of a larger breast cup size.

BACKGROUND TO THE INVENTION

Aside from providing support, many brassieres are designed to enhance the appearance of a wearer's bust, generally by lifting the breasts up and pushing them forward or away from the wearer's body, and/or toward each other to create the illusion of a more substantial cleavage. As a matter of comfort, any cosmetic enhancement should be achieved without any excessive squeezing, or other constriction of the wearer's breasts which may cause discomfort.

A variety of methods have been employed to accomplish these lifting and pushing effects including the use of an under wire which runs approximately from the point at which the shoulder straps connect to each of the breast cups, and run along the lower periphery of each breast cup, and the provision of additional straps to lift the breast cups with some variations of such straps being positioned so as to pull the breast cups towards each other.

Another approach to enhancing the bust involves the use of breast pads otherwise known as "cookies" or "chicken fillets" which are inserted into each breast cup to provide padding and thereby create the illusion of a larger breast size. Such "cookies" may be formed from various resilient materials including foam and are typically positioned within the lower portion of breast cup. The "cookies" are usually substantially oval in shape, hence the synonym "chicken fillet".

It is an object of the present invention to provide a breast cup construction which enhances the bust of a wearer of a brassiere which incorporates such a breast cup construction.

Other objects and advantages of the invention will become apparent to those of ordinary skill in the art having reference to the following specification together with its drawings.

SUMMARY OF THE INVENTION

According to an aspect of the present invention, there is provided a molded breast cup comprising:

a outer panel including an outer fabric layer;

a inner panel including an inner fabric layer to be worn against a wearer's skin;

a middle layer disposed between the outer panel and the inner panel and positioned within a substantial portion of the breast cup including at least a central region thereof, the middle layer comprising fill having sufficient thickness such that the outer panel corresponds to a first breast cup size being more than substantially one breast cup size above a second breast cup size corresponding to the inner panel.

Preferably, the breast cup is molded so as to apply a pushing force against an underside of the wearer's breast causing the breast to be displaced into the upper region of the breast cup.

More preferably, the middle layer is substantially circular in shape.

More preferably, the middle layer comprises fibre fill.

Preferably, the outer panel further includes a memory foam layer attached to the outer fabric layer and the inner panel further includes a soft foam layer attached to the inner fabric layer.

In another embodiment, a thickness of the breast cup tapers towards a periphery of the breast cup and particularly towards an upper portion of the breast cup.

In one form of the invention, the thickest part of the breast cup is between 25 millimeters and 35 millimeters thick.

In another form of the invention, the thickest part of the breast cup is approximately 30 millimeters thick.

Preferably, the thickness around the periphery of the breast cup is between 15 millimeters and 20 millimeters thick.

Most preferably, the first breast cup size is around two sizes larger than the second breast cup size.

According to another aspect of the present invention, there is provided a molded brassiere comprising:

two molded breast cups each including:

a outer panel including an outer fabric layer;

a inner panel including an inner fabric layer to be worn against a wearer's skin;

a middle layer disposed between the outer panel and the inner panel and positioned within a substantial portion of the breast cup including at least a central region thereof, the middle layer comprising fill having sufficient thickness such that the outer panel corresponds to a first breast cup size being more than substantially one breast cup size above a second breast cup size corresponding to the inner panel;

an intermediate bridging region extending between the two breast cups; and a back strap extending from each of the two breast cups for securing the brassiere to a torso of a wearer.

According to yet another aspect of the present invention, there is provided a method of making a molded breast cup, the method comprising the following steps:

forming an outer panel including an outer fabric layer;

forming an inner panel including an inner fabric layer to be worn against a wearer's skin;

trimming to size fill having sufficient thickness to provide a middle layer;

placing the middle layer on the outer panel and beneath the inner panel such that the middle layer will be positioned within a substantial portion of the breast cup including at least a central region thereof before molding the combined layers to form two breast cups; and trimming each molded breast cup to the desired shape;

wherein the middle layer has sufficient thickness such that the outer panel corresponds to a first breast cup size being more than substantially one breast cup size above a second breast cup size corresponding to the inner panel.

The steps of forming the outer and inner panels may include laminating the respective fabric layers with a foam layer.

Preferably the step of forming the outer panel includes laminating the outer fabric layer with a memory foam.

Preferably, the step of forming the inner panel includes laminating the inner fabric layer with a soft foam.

In one form of the invention, the step of molding the combined layers to form two breast cups comprises the following steps:

performing a first molding of the outer panel to form two breast cups; and placing the middle layer and inner panel on the outer panel such that the middle layer will be positioned within a substantial portion of the breast cup including at least a central region thereof and performing a second molding to form two breast cups.

In another form of the invention, the step of molding the combined layers to form two breast cups comprises the following steps:

performing a first molding of either of the outer and inner panels to form two breast cups; and placing the middle layer and the other of the outer and inner panels on the first molded panel such that the middle layer will be positioned within a substantial portion of the breast cup including at least a central region thereof and performing a second molding to form two breast cups.

According to still another aspect of the present invention, a method for making a molded brassiere, comprising the following steps:

forming an outer panel including an outer fabric layer;

forming an inner panel including an inner fabric layer to be worn against a wearer's skin;

trimming to size fill having sufficient thickness to provide a middle layer;

placing the middle layer on the outer layer and beneath the inner layer such that the middle layer will be positioned within a substantial portion of the breast cup including at least a central region thereof before molding the combined layers to form two breast cups; and trimming the molded layers to define two breast cups, an intermediate bridging region extending there between and a back strap;

wherein the middle layer has sufficient thickness such that the outer panel corresponds to a first breast cup size being more than substantially one breast cup size above a second breast cup size corresponding to the inner panel.

BRIEF DESCRIPTION OF THE DRAWINGS

It will be convenient to hereinafter describe the invention in greater detail by reference to the accompanying figures which facilitate understanding of the method according to this invention. The particularity of the figures and the related description is not to be understood as superseding the generality of the broad identification of the invention as given in the attached claims.

DETAILED DESCRIPTION

Figure 1A:
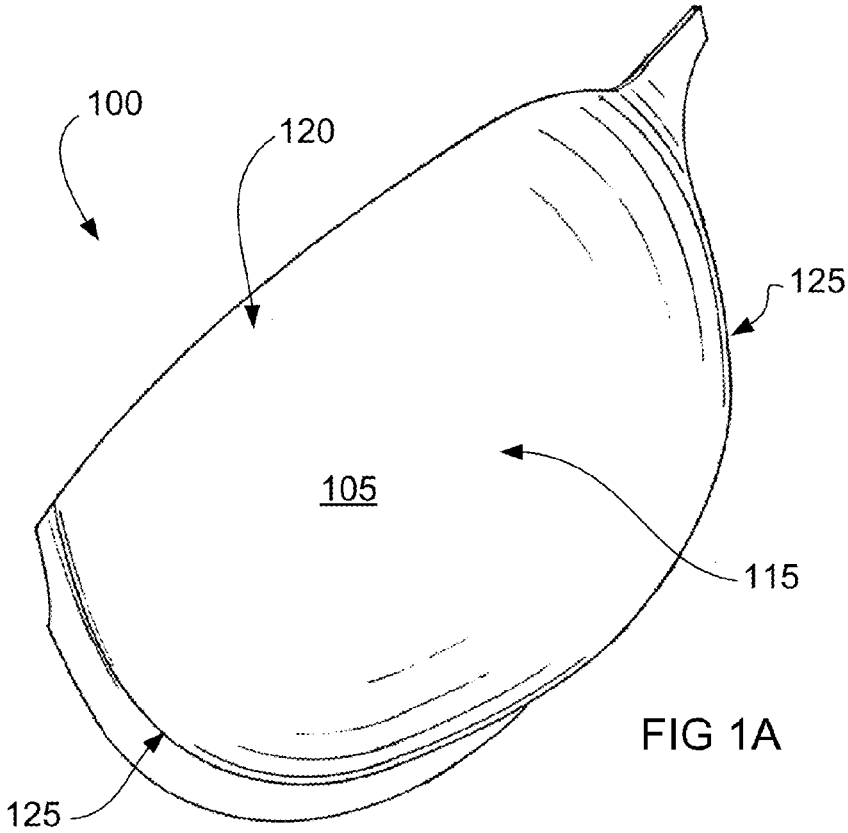
FIG. 1A is a front on perspective view of a breast cup embodying the principles of the present invention.
Figure 1B:
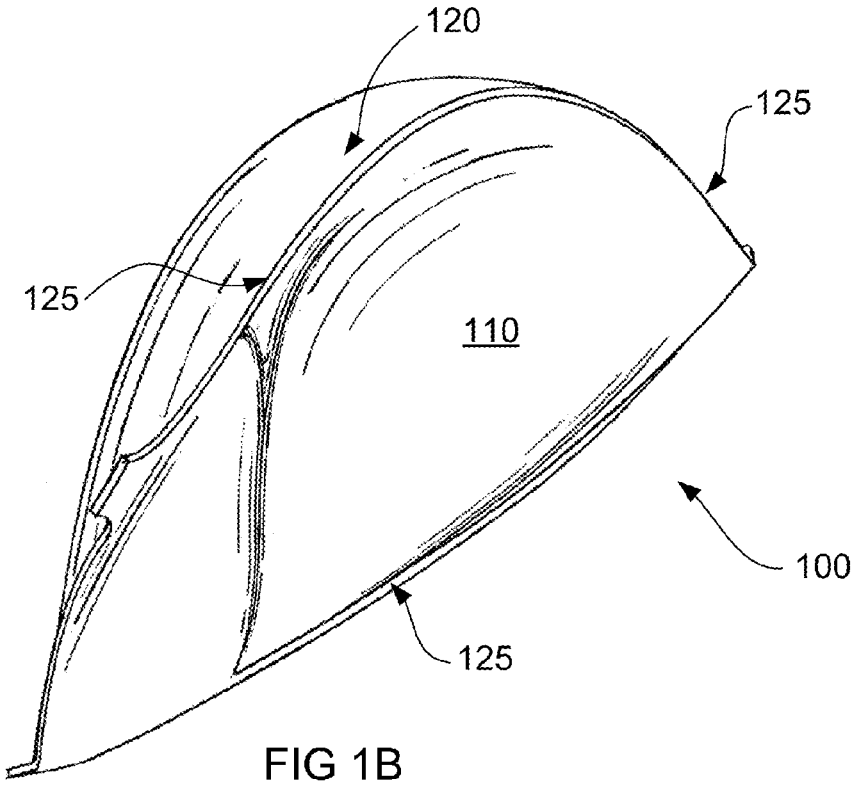
FIG. 1B is an perspective view of the breast cup of FIG. 1 showing the inside of the breast cup.

Referring firstly to FIGS. 1A and 1B, there is provided a molded breast cup 100 comprising an outer panel 105 which includes an outer fabric layer and an inner panel 110 including an inner fabric layer to be worn against a wearer's skin. A middle layer (not shown) is disposed between the outer panel 105 and the inner panel 110. The middle layer comprises fill being sufficiently thick such that the outer panel 105 corresponds to a breast cup size which is more than one breast cup size above the breast cup size which corresponds to the inner panel 110. In a preferred embodiment, the middle layer comprises fill being sufficiently thick such that the outer panel 105 corresponds to a breast cup size which is two or approximately two breast cup size above the breast cup size which corresponds to the inner panel 110.

Figure 2:
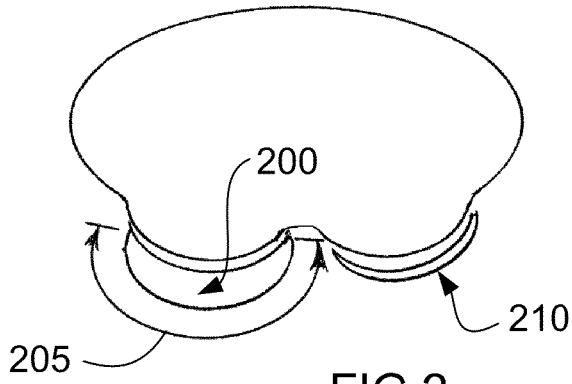
FIG. 2 shows a brassiere incorporating a breast cup embodying the principles of the present invention on one side only as viewed from above when fitted to a wearer.

Referring now to FIG. 2, the molded breast cup 200 according to an embodiment of the present invention provides the illusion of a larger breast cup size as shown by the outer measurement 205, by incorporating a middle layer comprising fill being sufficiently thick to increase the breast cup size by more than one size when compared with conventional breast cup 210. The breast cup 200 embodying the principles of the present invention thereby enhances the appearance of a wearer's bust. For example, if the conventional breast cup 210 were a "B" cup; the outer measurement 205 of the molded breast cup 200 embodying the principles of the present invention would correspond to that of a "D" cup. The inner measurement of the molded breast cup 200 is preferably slightly smaller than that which would be found in a conventional breast cup 210 (i.e. slightly smaller being not so much as one whole cup size smaller than the inner measurement for a conventional "B" cup). This "smaller measurement" facilitates the "pushing" or "squeezing" effect which prevents a gap forming between the upper, in particular the neckline, region of the breast cup and the wearer's skin as illustrated and described with reference to FIGS. 3A and 3B.

Referring back to FIGS. 1A and 1B, in order to achieve the illusion of a larger breast cup size, the middle layer is positioned within a substantial part of the breast cup 100 including at least a central portion 115 thereof. The breast cup is molded or molded to a shape so as to apply a pushing force against an underside of the wearer's breast causing the breast to be displaced into the upper region 120 of the breast cup. The upper region 120 of the breast cup being the region that sits against the upper side of a wearer's breast when fitted to a wearer.

The thickest part of the breast cup 100 is between 25 and 35 millimeters thick. In one particular embodiment, the thickest part of the breast cup 100 is approximately 30 millimeters thick. By way of comparison, for a conventional breast cup with no "cookie", the thickest point is typically about 3 to 7 millimeters. For a conventional breast cup with a "cookie", the thickest point is typically about 15 to 16 millimeters.

The thickness of the breast cup 100 tapers towards a periphery 125 of the breast cup and particularly towards an upper portion 120 of the breast cup to be worn against an upper side of a wearer's breast. The thickness around the periphery 125 of the breast cup 100 is between 15 and 20 millimeters thick.

Figure 3A:
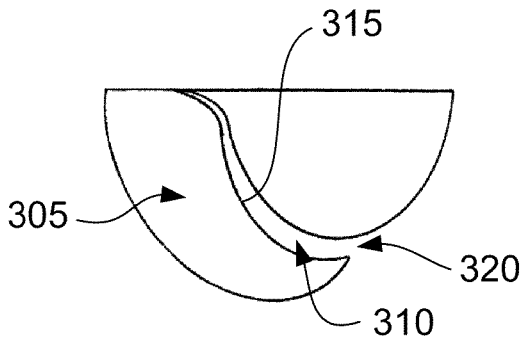
FIG. 3A is a schematic drawing showing a conventional breast cup fitted to a breast.
Figure 3B:
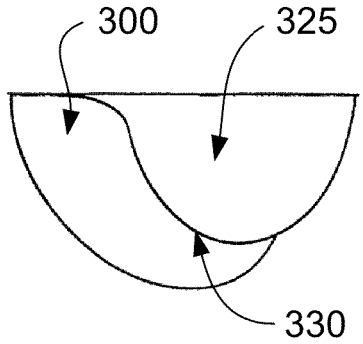
FIG. 3B is a schematic drawing showing a breast cup embodying the principles of the present invention fitted to a breast.

Referring now to FIGS. 3A and 3B, there is shown the effect of the breast cup 300 embodying the principles of the present invention (see FIG. 3B) when compared with a conventional breast cup 305 containing a conventional "cookie" (see FIG. 3A) which tends to create a gap 310 between the upper region of the breast cup 315 and the wearer's skin 320. The positioning of the middle fill layer over a substantial portion of the breast cup 300 and contouring of the breast cup of the present invention tends to push or squeeze the wearer's breast 325 towards the upper region of the breast cup 330 to prevent any such gap from forming (see FIG. 3B).

Figure 4A:
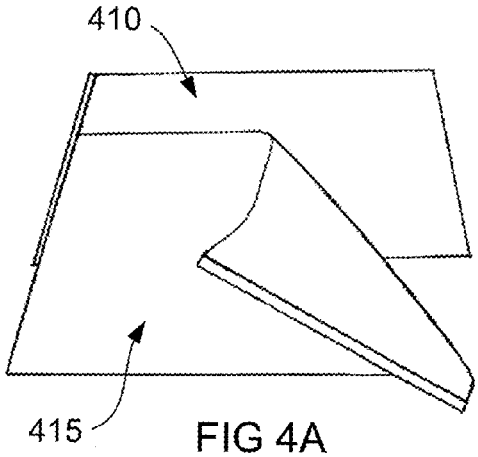
FIG. 4A shows the first step in a method for making breast cups embodying the principles of the present invention according to an aspect of the present invention.
Figure 4B:
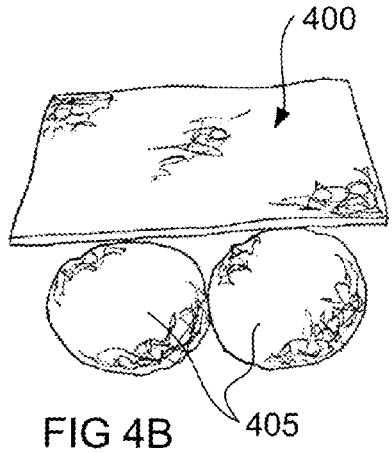
FIG. 4B shows the second step in a method for making the breast cups.

As can be seen in FIG. 4B, the precursor middle fill layer 400 is trimmed to form "cookies" 405 which are substantially circular in shape. Fibre fill is the preferred material for forming the middle fill layer. Fibre fill is preferred over the foam materials typically used to form "cookies" since the foam material tends to be weightier thereby negatively impacting the comfort of the wearer. A thick layer of foam also has poor air permeability which results in inability of the wearer's skin to breathe. In contrast fibre fill is relatively lightweight and air permeable and therefore does not adversely impact the comfort of the wearer. An example of a suitable fibre fill is ELK-300 of Aconic High-Tech Fiber (Shenzhen) Co., Ltd. in Shenzhen, China.

Since fibre fill alone is not as good as foam in forming a cup shape by molding and retaining the desired shape, particularly after repeated washings, a breast cup embodying the principles of the present invention will preferably include foam layer. The feel of foam is also generally more pleasing against the skin than fibre fill. In a preferred embodiment, there is a foam layer attached on the inner side (i.e., the side which is more proximate to a wearer's skin) to the outer fabric layer and another foam layer attached on the outer side (i.e., the side which is more distal from a wearer's skin) to the inner fabric layer. Preferably, the foam layer attached to the outer fabric layer comprises a resilient memory foam, which provides a hand feel akin to the human skin. Preferably, the foam layer attached to the inner fabric layer comprises a soft foam. Given that the inner panel is located immediately proximate to a wearer's skin, the soft foam provides better comfort to the wearer.

Referring now to FIGS. 4A to 4F, there is shown the sequence of steps for manufacturing a molded breast cup according to an embodiment of the present invention. In FIG. 4A, there is shown a precursor outer panel 410 including an outer fabric layer preferably laminated with a memory foam layer, together with a precursor inner panel 415 including an inner fabric layer preferably laminated with a soft foam layer. The inner fabric layer of the inner panel is so called since it is most proximate to the wearer's skin when the breast cup or brassiere incorporating the breast cup is fitted to the wearer. The outer fabric layer of the outer panel is so called since it is most distal from the wearer's skin when the breast cup or brassiere incorporating the breast cup is fitted to the wearer. The lamination of the fabric and foam layers is accomplished using adhesive which will stick the fabric and foam together when dry without heating. Referring now to FIG. 4B, there is shown a precursor middle layer 400 formed from fibre fill. The precursor middle layer 400 is trimmed to size to form "cookies" 405 which will fill a substantial portion of the resultant breast cup. The precursor middle layer 400 and "cookies" 405 must have sufficient thickness to achieve the object of the molded breast cup of the present invention which is to create the illusion of increasing the wearer's breast cup size by more than substantially one breast cup size.

Figure 4C:
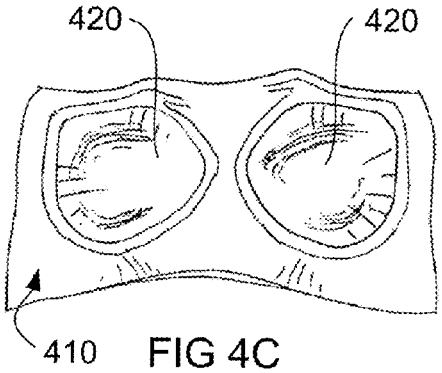
FIG. 4C shows the third step in a method for making the breast cups.

Referring now to FIG. 4C, the outer panel 410 is subjected to a molding process by sandwiching the outer panel between two complementary portions of a molding machine, each portion defining a two cup molding surface. The outer panel is placed such that the outer fabric layer is facing the concave portion of the molding machine. The molding temperature is typically 180° C. to 200° C. and the molding time is typically 120 seconds. FIG. 4C shows the resultant, molded outer panel 410 with the two cups 420 formed.

Figure 4D:
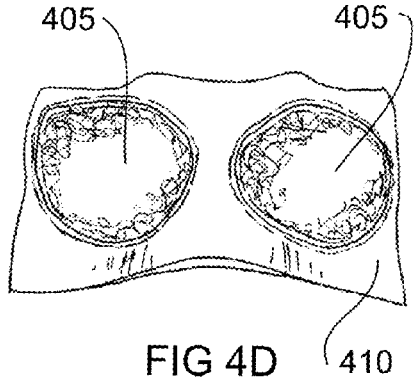
FIG. 4D shows the fourth step in a method for making the breast cups.

Referring now to FIG. 4D, the middle layer or "cookies" 405 are placed within the two cups 420 in the molded outer panel 410 such that the middle layer occupies a substantial portion of each cup which will eventually form a breast cup. The inner panel 415 (inner fabric layer laminated with a foam layer) (see FIG. 4A) is then placed on top of the outer panel and middle layer (not shown) with the foam layer facing the outer panel and middle layer, before the combined layer assembly is subjected to a further molding step as described in relation to FIG. 4C.

Before the second molding, for each of the outer and inner panels, the surface of the foam layer that is not facing the fabric layer is spayed with an adhesive which will dry without sticking but will stick when heated in a mold during the molding process. After the second molding, the outer panel 410 and the middle layer or "cookie" 405 are laminated with the inner panel 415 and the breast cup shapes formed.

Figure 4E:
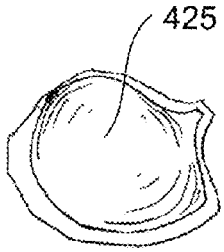
FIG. 4E shows the fifth step in a method for making the breast cups.
Figure 4F:
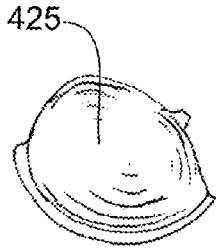
FIG. 4F shows the sixth and final step in a method for making the breast cups according.

Referring now to FIGS. 4E and 4F, once the breast cup chapes have been substantially formed, the breast cups are first cut and then trimmed from the molded assembly (not shown) to form the individual molded breast cups 425. FIG. 4E shows a breast cup having been cut out. FIG. 4F shows the breast cup having been trimmed.

Figure 5:
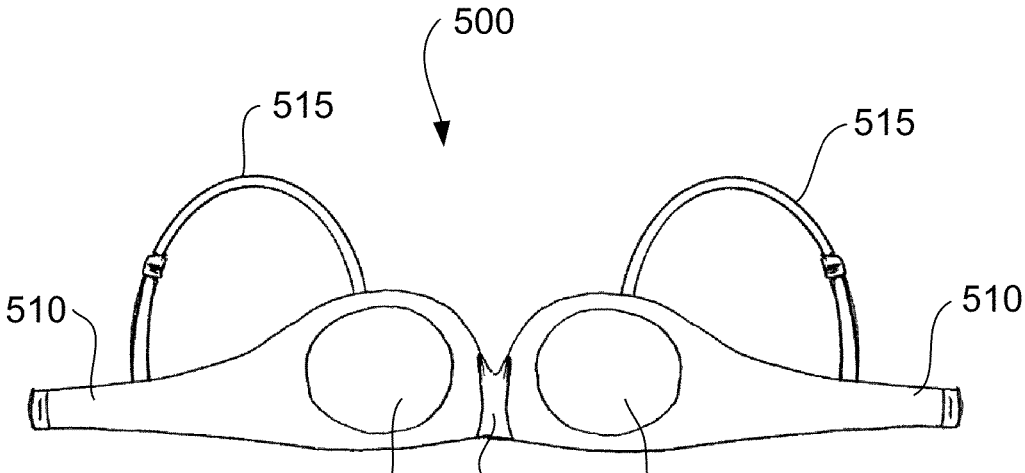
FIG. 5 is a schematic drawing of a brassiere incorporating a molded breast cup embodying the principles of the present invention.

Referring now to FIG. 5, a brassiere 500 may then be formed by attaching other components including bridging portion 505 and back strap or straps 510 securing the brassiere to the wearer and optionally under wire and shoulder straps 515 to the breast cups 520.

The present invention is also applicable to a molded one-piece bra, with or without a core assembly as described in U.S. Pat. No. 7,179,150 which is incorporated herein in its entirety by reference. Having performed the second molding, the whole brassiere is cut and trimmed rather than simply the individual breast cups. If a core assembly, as described in U.S. Pat. No. 7,179,150, is included, the thick "cookie" is placed between the two foam layers making up the core assembly.

The advantage of the present invention is the ability to boost the bra cup size by more than one size up, or preferably by (about) two sizes up, so that when a wearer who typically wears, for example, a "B" cup size brassiere is wearing a brassiere incorporating the breast cups of the present invention, it could achieve the illusion of, for example, a "D" cup size brassiere (i.e., the illusion of the wearer having a larger breast size), while simultaneously maintaining a good level of comfort and a natural look.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

What is claimed is:

1. A molded breast cup comprising:

a outer panel including an outer fabric layer;

a inner panel including an inner fabric layer to be worn against a wearer's skin;

a middle layer disposed between the outer panel and the inner panel and positioned within a substantial portion of the breast cup including at least a central region thereof, the middle layer comprising fill, the fill having a thickness sufficiently large such that the outer panel is sized to correspond to a first breast cup size, the first breast cup size being more than one breast cup size above a second breast cup size corresponding to a size of the inner panel, the outer panel, inner panel and middle layer molded together to form the molded breast cup.

2. A molded breast cup according to claim 1, wherein the breast cup is molded so as to apply a pushing force against an underside of the wearer's breast causing the breast to be displaced into the upper region of the breast cup.

3. A molded breast cup according to claim 1, wherein the middle layer is substantially circular in shape.

4. A molded breast cup according to claim 1, wherein a thickness of the breast cup tapers towards a periphery of the breast cup and particularly towards an upper portion of the breast cup.

5. A molded breast cup according to claim 4, wherein the thickest part of the breast cup is between 25 millimeters and 35 millimeters thick.

6. A molded breast cup according to claim 4, wherein the thickest part of the breast cup is approximately 30 millimeters thick.

7. A molded breast cup according to claim 4, wherein the thickness around the periphery of the breast cup is between 15 millimeters and 20 millimeters thick.

8. A molded breast cup according to claim 1, wherein the first breast cup size is two sizes larger than the second breast cup size.

9. A molded breast cup according to claim 1, wherein the outer panel further includes a memory foam layer attached to the outer fabric layer and the inner panel further includes a soft foam layer attached to the inner fabric layer.

10. A molded breast cup according to claim 1, wherein the middle layer comprises fiber fill.

11. A molded brassiere comprising:

two molded breast cups each including:

a outer panel including an outer fabric layer;

a inner panel including an inner fabric layer to be worn against a wearer's skin;

a middle layer disposed between the outer panel and the inner panel and positioned within a substantial portion of the breast cup including at least a central region thereof, the middle layer comprising fill, the fill having a thickness sufficiently large such that the outer panel is sized to correspond to a first breast cup size, the first breast cup size being more than one breast cup size above a second breast cup size corresponding to a size of the inner panel the outer panel, inner panel and middle layer molded together to form the molded breast cup;

a bridging region extending between the two breast cups; and a back strap extending from each one of the two breast cups.

12. A method of making a molded breast cup, the method comprising the following steps:

forming an outer panel including an outer fabric layer;

forming an inner panel including an inner fabric layer to be worn against a wearer's skin;

trimming to size fill having sufficient thickness to provide a middle layer;

placing the middle layer on the outer panel and beneath the inner panel such that the middle layer will be positioned within a substantial portion of the breast cup including at least a central region thereof before molding the combined layers to form two breast cups;

molding the outer panel, inner panel and middle layer together; and trimming the molded breast cup to the desired shape;

wherein the middle layer has a thickness sufficiently large such that the outer panel is sized to correspond to a first breast cup size, the first cup size being more than one breast cup size above a second breast cup size corresponding to a size of the inner panel, the outer panel, inner panel and middle layer molded together to form the molded breast cup.

13. A method of making a molded breast cup according to claim 12, wherein the steps of forming the outer and inner panels includes laminating the respective fabric layers with a foam layer.

14. A method of making a molded breast cup according to claim 12, wherein the step of forming the outer panel includes laminating the outer fabric layer with a memory foam.

15. A method of making a molded breast cup according to claim 12, wherein the step of forming the inner panel includes laminating the inner fabric layer with a soft foam.

16. A method of making a molded breast cup according to claim 12, wherein the step of molding the outer panel, inner panel and middle layer together comprises the following steps:

performing a first molding of either of the outer and inner panels to form two breast cups; and placing the middle layer and the other of the outer and inner panels on the first molded panel and performing a second molding to form two breast cups.

17. A method for making a molded brassiere, comprising the following steps:

forming an outer panel including an outer fabric layer;

forming an inner panel including an inner fabric layer to be worn against a wearer's skin;

trimming to size fill having sufficient thickness to provide a middle layer;

placing the middle layer on the outer panel and beneath the inner panel such that the middle layer will be positioned within a substantial portion of the breast cup including at least a central region thereof before molding the combined layers to form two breast cups;

molding the outer panel, inner panel and middle layer together; and trimming the molded layers to define two breast cups, a bridging region extending therebetween and a back strap;

wherein the middle layer has a thickness sufficiently large such that the outer panel is sized to correspond to a first breast cup size, the first cup size being more than one breast cup size above a second breast cup size corresponding to a size of the inner panel, the outer panel, inner panel and middle layer molded together to form the molded breast cup.

* * * * *